US006481609B2

(12) United States Patent
Dittrich et al.

(10) Patent No.: US 6,481,609 B2
(45) Date of Patent: Nov. 19, 2002

(54) HOLDER FOR A DRIVE PISTON OF A SETTING TOOL

(75) Inventors: Tilo Dittrich, Rankweil (AT); Franz Büchel, Ruggell (LI); Gerhard Ehmig, Rankweil (AT); Thomas Sperrfechter, Zizers (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/072,716

(22) Filed: Feb. 6, 2002

(65) Prior Publication Data

US 2002/0108991 A1 Aug. 15, 2002

(30) Foreign Application Priority Data

Feb. 9, 2001 (DE) ..... 101 05 880

(51) Int. Cl.[7] ..... B25C 1/14
(52) U.S. Cl. ..... 227/10; 227/130; 173/210
(58) Field of Search ..... 227/9, 10, 11, 227/130; 173/210, 211, 55

(56) References Cited

U.S. PATENT DOCUMENTS

| | | | | | |
|---|---|---|---|---|---|
| 4,867,365 | A | * | 9/1989 | Buechel et al. | 227/9 |
| 4,941,391 | A | * | 7/1990 | Ehmig et al. | 227/10 |
| 5,538,172 | A | * | 7/1996 | Jochum et al. | 227/130 |
| 5,797,534 | A | * | 8/1998 | Almeras et al. | 227/10 |
| 5,881,940 | A | * | 3/1999 | Almeras et al. | 227/10 |
| 6,092,710 | A | * | 7/2000 | Kersten | 173/211 |
| 6,123,243 | A | * | 9/2000 | Pfister et al. | 227/10 |

* cited by examiner

*Primary Examiner*—Scott A. Smith
(74) *Attorney, Agent, or Firm*—Sidley Austin Brown & Wood, LLP

(57) ABSTRACT

A piston holder for a drive piston of a setting tool and including at least one clamp member (18; 24; 25; 36; 39; 40; 52; 58) that is constantly non-rigidly pressed against a circumference of the drive piston (8), and elements for supporting the at least one clamp member for an eccentric movement in a plane in which a central axis (10*a*) of the drive piston (8) is located.

15 Claims, 7 Drawing Sheets

HOLDER FOR A DRIVE PISTON OF A SETTING TOOL

BACKGROUND OF THE INVENTION

1. Field of the Invention

The present invention relates to a holder for a drive piston of a setting tool.

2. Description of the Prior Art

European Publication EP-O 346275 B1 discloses an explosive powder charge-operated setting tool including a piston guide and a drive piston displaceable in the piston guide. The piston guide has radial openings facing the drive piston, and spring-biased braking balls extending through the radial openings and engaging the drive piston. The spring, which applies a biasing force to the braking balls is formed as a ring spring for applying a radially acting, with respect to the piston, biasing force to the braking balls. The ring spring is provided on its inner profile with a bearing surface acting on the braking ball. The bearing surface is inclined to the piston at an acute angle that opens in a direction opposite a setting direction.

In an ignition-ready position of the drive piston, the braking balls engage the circumferential surface of the piston body of the drive piston. When the drive piston moves in the setting direction, it entrains therewith the braking balls, rolling them over. The braking balls expand the ring spring, which results in the bearing surface transmitting the radial biasing force to the braking balls. The braking balls are pressed radially against the piston body by the ring spring. Even with a small displacement of the drive piston in a direction opposite the setting direction, the braking effect can be substantially reduced or eliminated, as the braking balls displace in the same direction as the drive piston, unloading the ring spring. After being unloaded, the ring spring does not press any more the braking balls against the piston body. Further, a possibility still remains that the drive piston would be displaced, before ignition or firing of the setting tool, in the setting direction as a result of, e.g., the setting tool being pressed too hard against a constructional component. The displacement in the return direction is effected due to cooperation of the ring spring with the braking balls. Thereby, the drive piston is reliably retained in its ignition-ready position.

U.S. Pat. No. 4,162,033 discloses a setting tool with a braking element that continuously applies a braking force to the drive piston.

An object of the present invention is to provide a piston holder having a simplified design and which would reliably retain the drive piston in its ignition-ready position in the absence of ignition.

SUMMARY OF THE INVENTION

This and other objects of the present invention, which will become apparent hereinafter, are achieved by providing a piston holder including at least one clamp member that is constantly non-rigidly pressed against a circumference of the drive piston and elements for supporting the at least one clamp member for an eccentric movement in a plane in which a central axis of the drive piston is located. The piston holder according to the present invention is particularly suitable for braking or retaining a drive piston, e.g., of explosive powder charge-operated setting tool, though it can also be used in a setting tool driven upon ignition of an air-fuel mixture.

The basic idea of the present invention consists in providing at least one clamp member located sidewise of the drive piston and engaging the same, so that the drive piston entrains the at least one clamp member upon moving in a drive-out or setting direction of the drive piston as a result of frictional contract therebetween, with the clamp member being tilted or pivoted about a pivot point located eccentrically relative to the clamp member in such a way that it runs into the travel path of the drive piston. Because the clamp member is simultaneously pressed against the drive piston, the frictional forces between the clamp member and the drive piston increase, providing for braking of the drive piston. When the setting tool is fired or ignited, the drive piston-displacing force increases and when it exceeds a predetermined value, the clamp member releases the drive piston due to its elastic deflection, and the drive piston can slide through the piston guide. There is provided in this way a speed-dependent friction coefficient that insures reduction of friction in the contact point between the clamp member and the drive piston with the increase of the drive piston displacement speed. The non-rigid support of the clamp member serves practically as a overload protection means against complete stop of the drive piston based on the principle of self-powering of the clamping action.

Upon movement of the drive piston in a direction opposite to its drive-out or setting direction, it again entrains the clamp member that would pivot or tilt about its eccentric pivot point in the opposite direction. The clamp member, being pivoted in the opposite direction, would apply a smaller pressure to the drive piston so that the drive piston can move to its initial or ignition-ready position substantially friction-free. The drive piston is held in its ignition-ready position by the clamp member that is constantly spring-biased against the drive piston. That insures a reliable positioning of the drive piston in its ignition-ready position.

In principle, the clamp member is formed as a pendulum one end of which is pressed against the circumferential surface of the drive piston, and at the other end of which, there is provided a pivot point radially spaced from the drive piston and pressure-biased toward the drive piston. In the drive-out or setting direction of the drive piston, this pivot point lies in front of the contact point of the clamp member and the drive piston when the drive piston is in its ignition-ready position. Upon entrainment of the clamp member by the drive piston movable in its drive-out or setting direction, the friction force increases as a result of the pivotal or tilting movement of the clamp member until the clamp member engages a stop provided in front of the clamp member in the drive piston drive-out direction. After the clamp member engages the stop, the pivot point and the contact point of the clamp member with the drive piston lie one behind the other in the radial direction relative to the drive piston. Upon movement of the drive piston in the opposite direction, i.e., to its initial, ignition-ready position, the pendulum would rotate or pivot in opposite direction, releasing the drive piston.

According to one embodiment of the present invention, the clamp member is freely tiltably retained in a receiving space stationary with respect to the setting tool. Practically, the clamp member is loosely located in this space and is radially pressed against the drive piston.

The clamp member can be formed as a rigid body and be pressed against the drive piston by spring means. However, the clamp member can also be formed as an elastic body supported between the drive piston and a wall of the receiving space radially spaced from the drive piston.

According to the present invention, a plurality of clamp members can be uniformly distributed in a circumferential direction of the drive piston and be biased against the drive piston by a common ring spring.

In principle, the clamp member can have different shapes in the plane extending in the axial direction of the drive piston. It only needs to be insured that the contact point of the clamp member, at which the clamp member engages the drive piston, be capable of running into the travel path of the drive piston upon movement of the drive piston in its drive-out or setting direction.

According to a further embodiment, the clamp member pivots about an eccentric axle. The eccentric axle can be stationary arranged in the setting tool, and the clamp member can be formed as an elastic body. In this case also, the clamp member functions as a pendulum that runs into the travel path of the drive piston when it moves in its drive-out direction until the clamp member abuts a stop.

Alternatively, the excentric axle can be non-rigidly supported in the radial, with respect to the drive piston, direction, and the clamp member can be formed as a rigid body. In this case, self-clamping of the clamp member is prevented.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiment, when read with reference to the accompanying drawings.

DETAILED DESCRIPTION OF THE PREFERRED EMBODIMENT

Figure 1:
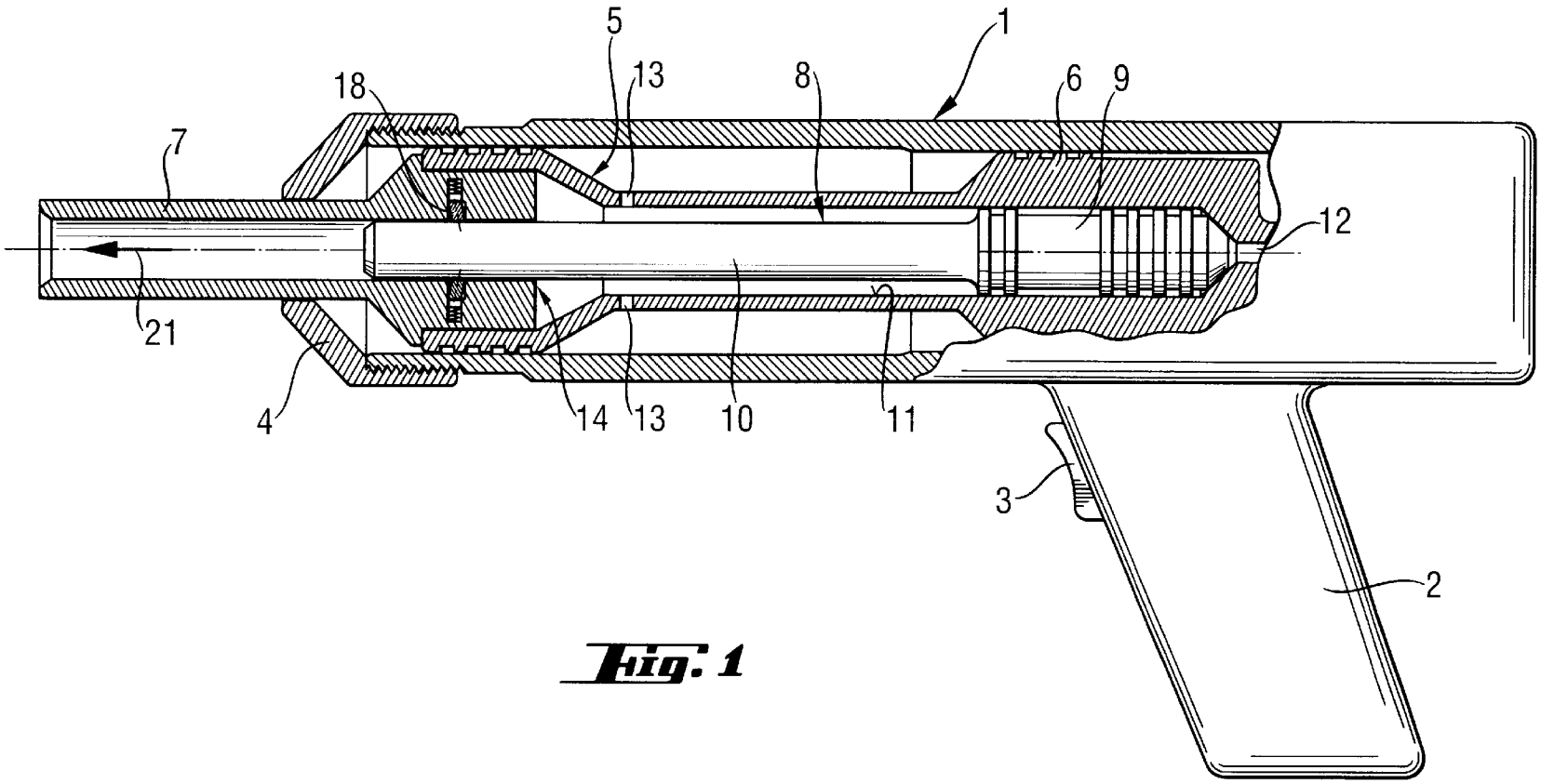
FIG. 1 a perspective, partially cross-sectional view of a setting tool that can be equipped with a piston holder according to the present invention.

A piston holder according to the present invention can be used with a setting tool a partially cross-sectional view of which a shown in FIG. 1. The setting tool, which is shown in FIG. 1, is an explosive power charge-operated tool. However, the inventive piston holder can also be used in a setting tool driven upon ignition of an air-fuel mixture.

The setting tool, which is shown in FIG. 1, has a housing 1 with a handle 2 and a trigger 3 which, in the embodiment shown in FIG. 1, is provided in the handle. A stop socket 4 is screwed to the housing 1 at the housing end facing in the setting direction of the setting tool. A two-part piston guide 5 is displaceably arranged in the housing 1. The piston guide 5 is, formed of rear and front parts 6 and 7, respectively. A drive piston 8 is arranged in the piston guide 5. The drive piston 8 has its head 9 displaceable in the rear part 6 and its body 10 displaceable in the front part 7. An inflow channel 12 for explosion gas of an explosive power charge opens into guide bore 11 of the part 6 at the rear end of the bore 11. At its front end, the part 6 has breakthroughs 13 for releasing air, which is accumulated in front of the piston head 9 of the piston 8 in the piston drive-out or setting direction upon movement of the drive piston in that direction. The front end region of the rear part 6 concentrically overlaps the rear region of the front part 7. The front part 7 extends beyond the stop socket 4 in the setting direction and forms a delivery tube. The rear end of the front part 7 can extend in form of a tubular projection into the guide bore 11, forming a stop limiting the travel of the drive piston 8.

The piston holder according to present invention can be located in a receiving region 14.

Figure 2:
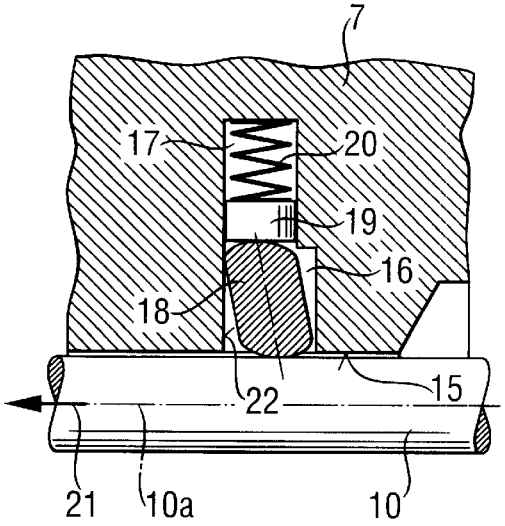
FIG. 2 a partial cross-sectional view showing a first embodiment of a piston holder according to the present invention with a rigid clamp member in its slightly clamping position.
Figure 3:
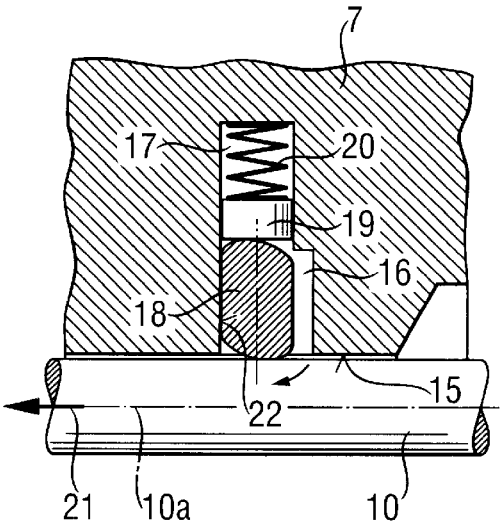
FIG. 3 a partial cross-sectional view showing the first embodiment of a piston holder according to the present invention with the rigid clamp member in its strong clamping position.

A first embodiment of a piston holder according to the present invention is shown in FIGS. 2–3.

In the embodiment shown in FIGS. 2–3, the body 10 of the drive piston 8 is guided in a guide channel 15 in the front part 7. In the wall of the front part 7, there is provided a receiving space or cavity 16 longitudinally extending transverse to the axis 10*a* of the piston body 10. A further, radially extending cavity 17 adjoins the receiving cavity 16. The cavity 16, viewed in the axial direction of the piston 10, is wider than the cavity 17 in this direction.

A rigid clamp member 18 is arranged in the receiving cavity 16. The clamp member 18 can be formed as a disc, a cuboid, or a cylinder. The clamp member 18 is arranged in the cavity 16, viewed in the circumferential direction of the piston body 10, with a minimal clearance. However, it is capable of tilting in a plane in which the piston body axis 10*a* is located. A compensating piston 19 is slidably arranged in the further cavity 17. The compensating piston 19 is capable of sliding in the radial direction with respect to the piston body 10. A compression spring 20 is arranged in the further cavity 17 between the compensating piston 19 and the bottom of the cavity 17. The compression spring 20 biases the compensating piston 19 against an end surface of the clamp member 18 remote from the body 10, thereby biasing the clamp member 18 against the piston body 10.

The clamp member 18 has, in the plane of the piston body axis 10*a* a rhomb-like shape, with the short sides of the rhomb having, in a radial direction of the piston body 10, a convex shape.

In the ignition-ready position of the drive piston 8, the clamp member 18 occupies a tilting position that is shown in FIG. 2. The clamp member 18 can be viewed as a pendulum the fulcrum or contact point of which with the compensating piston 19 lies, when viewed in a setting direction in the ignition-ready position of the drive piston 8, in front of the contact point of the clamp member 18 with the piston body 10. With such position of the clamp member 18 in the ignition-ready position of the drive piston 8, the compression spring 20 insures that the drive position 8 is reliably held in its ignition-ready position. The biasing force of the compression spring 20 is large enough that even in case the setting tool is pressed against a constructional component very hard, the drive piston 8 remains in its ignition-ready position.

Upon ignition or firing of the setting tool, the drive piston together with piston body 10, is sharply displaced in the setting direction 21. Upon displacement of drive piston 8 in the setting direction 21, the clamp member 18 pivots in the clockwise direction due to the friction between the clamp member 18 and the piston body 10 and between the clamp member 18 and the compensating piston 19. In the contact region between the clamp member 18 and the piston body 10, the fulcrum or the contact point between the clamp member 18 and the compensating piston 19 lies eccentrically with respect to the axis of the compensating piston 19. As a result of the excentrical arrangement of this fulcrum, with increase of the displacement of the drive piston 8 in the setting direction, the holding force acting on the drive piston 8 likewise increases due to increase loading or tensioning of the clamp member 18. With the displacement of the drive position 8, the clamp member 18 quickly reaches the stop 22 which is formed by a wall of the receiving cavity 16 facing in a direction opposite the setting direction. When the drive piston-displacing force exceeds a predetermined value, the clamp member 18, which is spring-biased, via the compensating piston 19, releases the drive piston 8, and the drive piston 8 slides through past the clamp member 18.

During the movement of the drive piston 8 in the direction opposite the setting direction, the clamp member 18 likewise is entrained in this direction by the drive piston 8, being pivoted counterclockwise and away from the stop 22. As a result of the counterclockwise rotation of the clamp member 18, the friction between the clamp member 18 and the piston body 10 noticeably decreases. Therefore, the drive piston 8 moves to its initial, ignition-ready position relatively friction-free, and is retained in this position by the compression spring 20.

In the position shown in FIG. 3, both contact points of the clamp member 18 with the compensating piston 19 and the body 10 of the drive piston 8 lie one above the other in the radial direction. This position of the contact points of the clamp member 18 is determined by the stop 22. In this position, the contact point between the clamp member 18 and the drive piston body 10 does not move any more in the direction toward the front-end of the setting tool, i.e., in the setting direction. Upon the movement of the drive piston 8 in the direction opposite of the setting direction, the clamp member 18 again exercises its clamping function.

Figure 4:
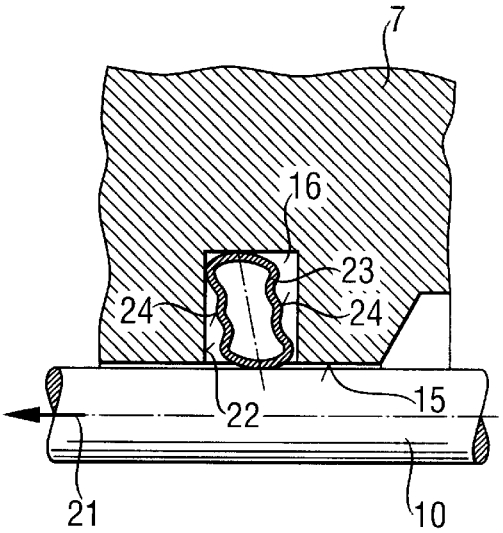
FIG. 4 a partial cross-sectional view showing a second embodiment of a piston holder according to the present invention with an elastic clamp member in its slightly clamping position.
Figure 5:
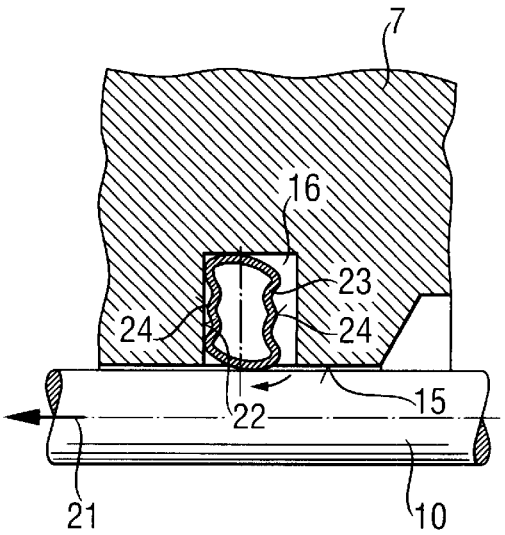
FIG. 5 a partial cross-sectional view showing the second embodiment of a piston holder according to the present invention with an elastic clamp member in its strong clamping position.

A second embodiment of a piston holder according to the present invention is shown in FIGS. 4–5. The embodiment of FIGS. 4–5 differs from that of FIGS. 2–3 in that the clamp member 23 is formed as an elastic or resilient member. Forming the clamp member 23 as a resilient member permits to eliminate the farther cavity 17 of FIG. 2, the compensating piston 19, and the compression spring 20. The clamp member 23 is arranged in the cavity 16 which, in the embodiment of FIGS. 4–5, has a closed bottom against which the clamp member 23 is supported. At its opposite end, the clamp body 23 is supported against the drive piston body 10. The elasticity of the clamp member 23 is obtained by forming the longitudinal, in the radical direction, sides 24 of the clamp member 23 more or less corrugated or folded. Otherwise, the clamp member 23 has, in the plane in which the piston body axis 10*a* lies, a cross-sectional shape approximately resembling the shape of a rhomb. The clamp member is so positioned in the receiving cavity 16 that the upper acute angle of the rhomb is arranged or lies in front of the lower acute angle in the setting direction. These positions of the acute angles of the rhomb are the same as in FIGS. 2–3. The short end surfaces of the rhomb are, as in the embodiment of FIGS. 2–3, formed as convex surfaces. The clamp member 23 can be formed, e.g., as a closed tubular profile having a relatively small length.

The clamp member 23 functions in the same way as the clamp member 18 of the embodiment of FIGS. 2–3, and therefore, its functioning would not be discussed any further.

It, of course, should be clear that several clamp members 18 or 23 can be provided over the circumference of the drive piston body 10. In case several clamp members are provided, they are substantially uniformly distributed over the drive piston body circumference. In case several clamp members 18 are provided, the system formed of compensating pistons 19 and springs 20 can be substituted by an a ring spring which would apply radial biasing forces to all of the clamp members 23.

Figure 7:
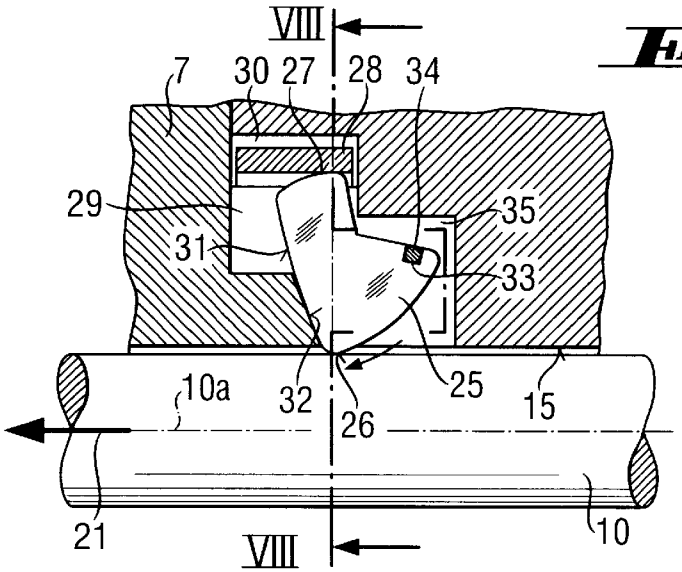
FIG. 7 a partial cross-sectional view showing the third embodiment of a piston holder according to the present invention with the rigid clamp member in its strong clamping position.
Figure 6:
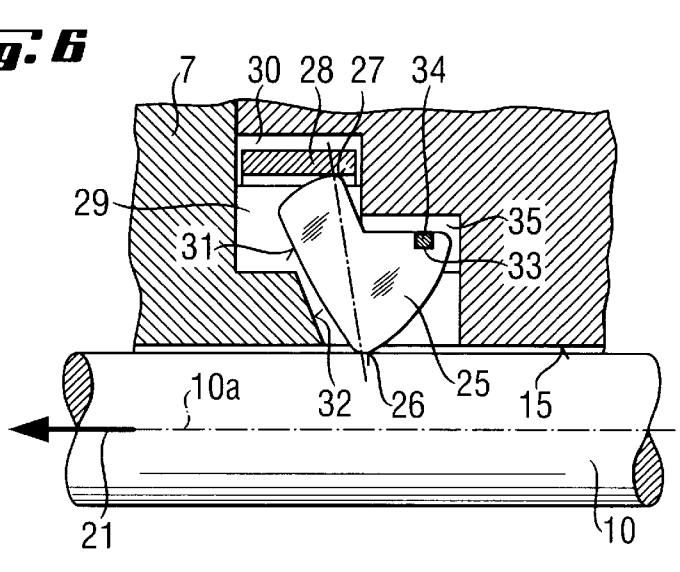
FIG. 6 a partial cross-sectional view showing a third embodiment of a piston holder according to the present invention with a rigid clamp member in its slightly clamping position.
Figure 8:
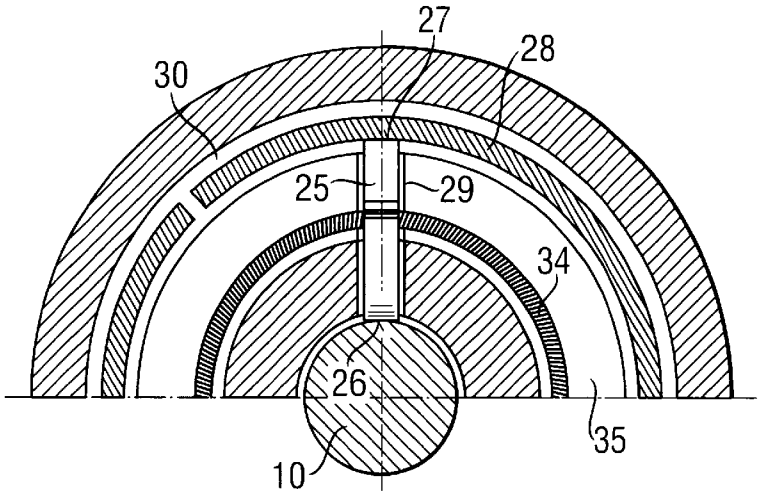
FIG. 8 a cross-sectional view along line VIII—VIII, in FIG. 7.

A third embodiment of the drive piston holder according to the present invention is shown in FIGS. 6–8. This holder is formed of a rigid clamp member 25. With the clamp member 25, several such clamp members 25 are provided in the circumferential direction of the piston body 10 at a substantially same angular distance from each other.

The clamp members 25 are disc-shaped. They have lower, slightly rounded edges 26 and upper strongly rounded edges 27. The clamp members 25 engage the piston body 10 with their lower edges 26 and with their outer edges 27, they contact a snap ring 28 provided with axially extending slots.

The snap ring 28 biases the clamp members 25 in the radial direction against the piston body 10. The clamp members 25 are located in receiving pockets 29 with a possibility of tilting in the plain in which the piston body axis 10*a* lies and can occupy a position perpendicular to the axis 10*a*. The receiving pockets 29 are provided in the rear portion of the front part 7. The pockets 29 have, in the circumferential direction of the piston body 10, a relatively small width. The snap ring 28 is arranged in a coaxial, with the piston body 10, space 30. The edges 26 and 27 are so offset, in the axial direction of the piston body 10, relative to each other in the ignition-ready position of the drive piston 8 that the edges 27 lie, in the setting direction, in front of the edges 26. The clamp members 25 have longitudinal edges 31 facing in the setting direction and forming, with the piston body axis 10*a*, acute angles, respectively, opening in the setting direction. At a small distance from the longitudinal edges 31, there is provided a stop 32 with a stop surface facing the longitudinal edges 31. This stop surface likewise forms an acute angle with piston body axis 10*a* opening in the setting direction. However, the angle, which is formed by the stop surface, is somewhat greater than the angles formed by the longitudinal edges 31.

At its end opposite the longitudinal edge 31, the clamp member 25 has a groove 33 in which a section of a snap ring 34 is received. The snap ring 34 is coaxial with the piston body 10. The snap ring 34 biases all of the clamp members 25 radially toward the shaft body 10. The snap ring 34 lies in a circumferential chamber 35. The snap ring 34 biases, in this way, all of the clamp members 25 toward the piston body 10, in particular in the regions of the clamp members 25 which are offset rearwardly, toward the rear end of the setting tool, relatively to the edge 26 of the clamp member 25.

Below functioning of the piston holder according to the third embodiment will be described in detail.

FIG. 6 shows a position of the clamp members 25 in the ignition-ready position of the drive piston 8. The snap ring 28 only slightly contacts the upper edges 27 of the clamp members 25, simply positioning the same. The snap ring 34 biases the clamp member 25 against the piston body 10 so that it reliably retained in its ignition-ready position. The drive position 8 does not move out from this position even when the setting tool is pressed hard against the constructional component, and a clearance remains between the longitudinal edge 31 and the stop 32.

Upon firing of the setting tool, the piston body 10 is displaced in the setting direction 21 entraining the clamp body 25 in the same direction due to its frictional engagement with the lower edges 26. During their displacement in the setting direction, the clamp member 25 pivot about their upper edges 27, with the upper edges 27 simultaneously moving slightly rearwardly. With this movement of the clamp members 25, the friction between the clamp members 25 and the piston body 10 increases due to the increase of the biasing force of the snap ring 28 that expands upon the movement of the upper edges 27 of the clamp members 25 rearwardly. Finally, the longitudinal edges 31 engage the stop surface of the stop 32. In this position of the clamp members 25, the upper and lower edges 27 and 26 of respective clamp members 25 are located practically one above the other in the radial direction. When the friction force between the clamp members 25 and the piston body 10 exceeds a predetermined value, the slotted snap ring 28 widens, releasing the piston body 10, and the piston body 10 can slide through the guide channel 15. The stop 32 prevents rotation of the clamp members 25 outwardly past their central positions.

Upon movement of the drive piston 8 in the direction opposite the setting direction, the clamp members 25 are entrained thereby toward the rear end of the setting tool and away from the stop 32. As a result of the movement of the clamp members 25, the friction force between the clamp members 25 and the piston body 10 sharply decreases, and the drive piston 8 is displaced to its ignition-ready position relatively friction-free. The snap ring 34 is formed approximately as an O-ring and slightly biases the clamp members 25 against the piston body 10 to keep the piston body 10 and thereby the drive piston 8 in their ignition-ready position.

Figure 10:
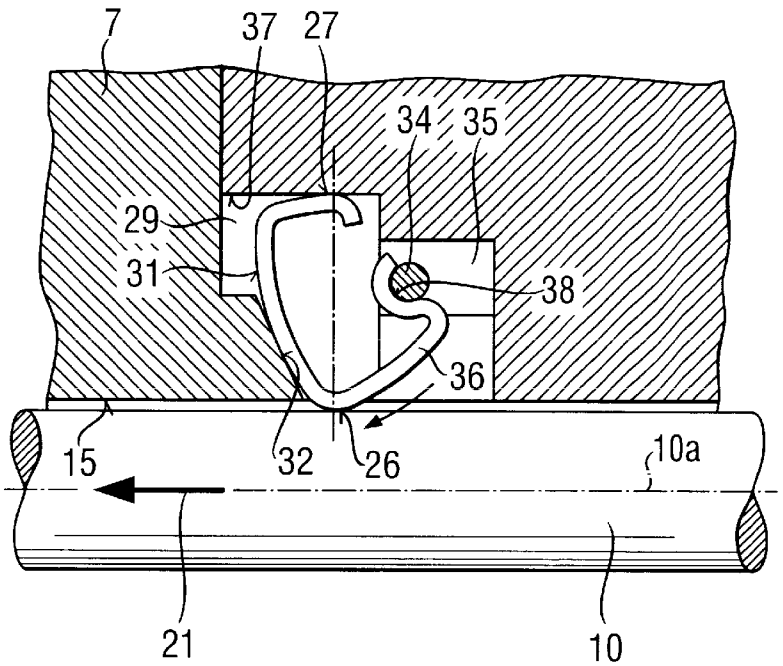
FIG. 10 a partial cross-sectional view showing a fourth embodiment of a piston holder according to the present invention with the clip-shaped elastic clamp member in its strong clamping position.
Figure 9:
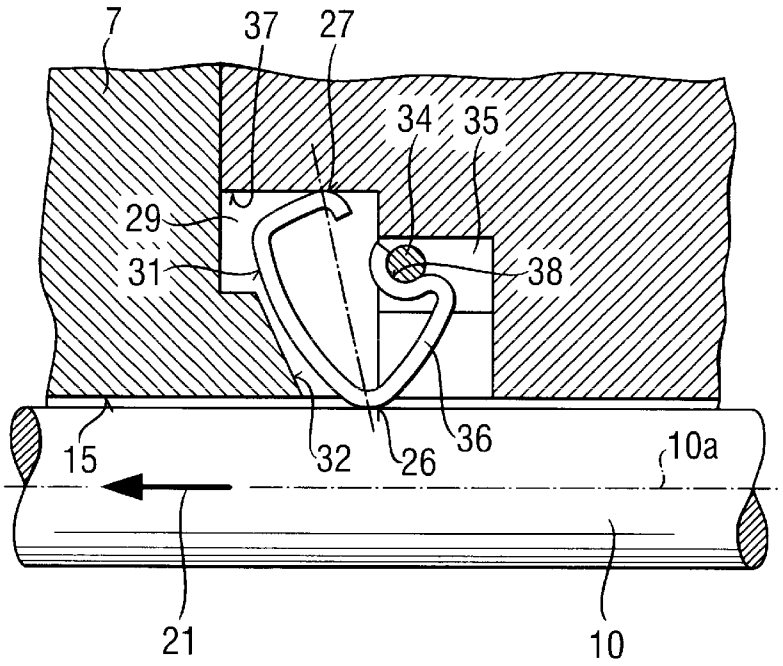
FIG. 9 a partial cross-sectional view showing a fourth embodiment of a piston holder according to the present invention with a clip-shaped elastic clamp member in its slightly clamping position.

A fourth embodiment of a piston holder according to the present invention is shown in FIGS. 9–10. In FIGS. 9–10, the same elements as in FIGS. 6–8 are designated with the same reference numerals and would not be discussed further.

In the embodiment of a piston holder shown in FIGS. 9–10, the clamp members 25 of FIGS. 6–8 are replaced by the spring shackles 36 which have the already discussed with reference to FIGS. 6–8, lower and upper edges 26 and 27 and longitudinal edges 31. With their upper edges 27, the shackles 36 are supported against the bottoms 37 of respective pockets 29. The edges 27 are formed by one ends of the shackles 36, the other end of the shackles 36 are curved in order to form grooves 38 in which the snap ring 34 is received.

The piston holder of FIGS. 9–10 functions in the same manner as the piston holder of FIGS. 6–8 and, therefore, functioning of the piston holder of FIGS. 9–10 would not be further described.

Figure 12:
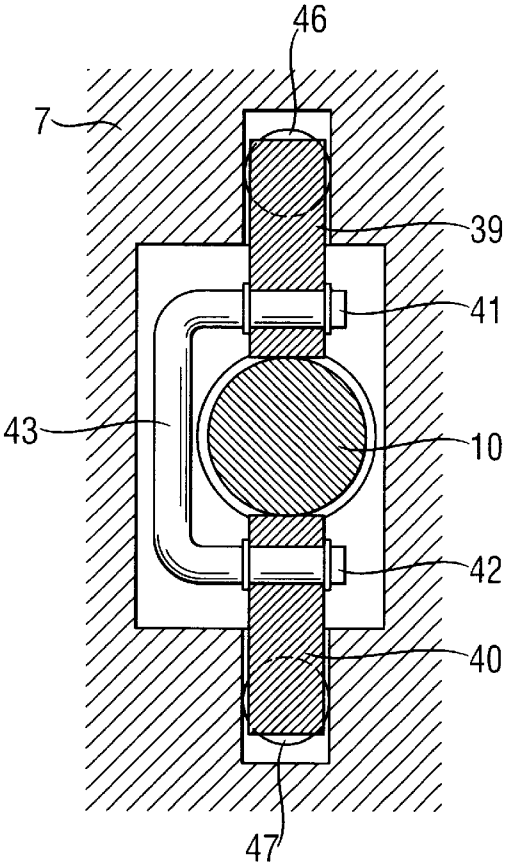
FIG. 12 a cross-sectional view along ling XII—XII in FIG. 11.
Figure 11:
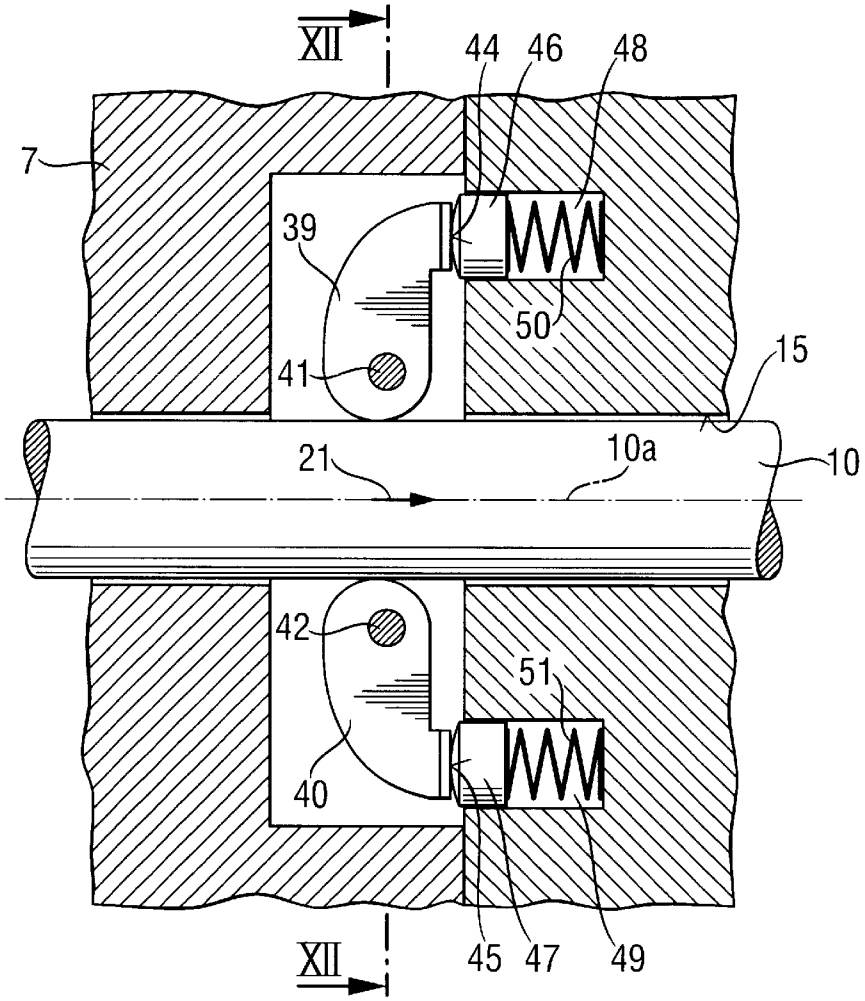
FIG. 11 a partial cross-sectional view showing a fifth embodiment of a piston holder according to the present invention with clamp members arranged along respective non-rigid axes.

FIGS. 11–12 show a fifth embodiment of a piston holder according to the present invention The piston holder shown in FIGS. 11–12 includes two eccentric washers 39, 40 which are arranged circumferentially diametrically opposite each other with respect to the piston body 10 displaceable in the guide channel 15. The eccentric washers 39, 40 pivot in the plane in which the axis 10*a* of the piston body 10 lies transverse to the plane of the piston body axis 10*a*, two axles 41, 42, which are formed by a common bow 43, are provided. The eccentric washers 39, 40 are pivotally supported on the axles 41, 42, respectively. The axles 41, 42 are spaced from the piston body 10 by a small distance, and the eccentric washers 39, 40 extend past the respective axles 41, 42, in the radial direction with respect to the piston body 10, by a relatively large distance. At their ends remote from the piston body 10, the eccentric washers 39, 40 are provided with stop surfaces 44, 45 which face in the setting direction 21 and engage, respectively, servo pistons 46, 47 supported for axial displacement in guides 48, 49. Two compression springs 50, 51 are located, respectively, in the guides 48, 49 and bias the servo pistons 46–47 toward the eccentric washers 39, 40.

It should be clear that more than two eccentric washers can be positioned circumferentially about the piston body 10, provided their axles are non-rigidly supported.

Below, the functioning of the piston holder according to the embodiment of FIGS. 11–12 will be discussed in detail.

In the ignition-ready position of the drive piston 8, the compression springs 50, 51 bias the eccentric washers 39, 40 about their axles 41, 42 so that the washers 39, 40 press against the piston body 10. Thus the compression springs 50, 51 insure retaining of the drive piston 8 in its ignition-ready position. The compression springs 50, 51 insure retaining of the drive piston 8 in its ignition-ready position even if the setting tool is pressed hard against a constructional component.

Upon ignition of firing of the setting tool, the drive position 8 moves in the setting direction 21, entraining therewith the eccentric washers 39, 40. In FIG. 11, the eccentric washers 39, 40 pivot about their respective axles 41, 42 counterclockwise and clockwise, respectively. As a result of the pivotal movement of the eccentric washers 39, 40, the width of their respective sections, which are located between the respective axles 41, 42 and the piston body increases, so that the eccentric washers 39, 40 brake the piston body 10. When the drive piston displacing force exceeds a predetermined value, the axles 41, 42 move away from the piston body 10 due to the elasticity of the bow 43, and the eccentric washers 39, 40 release the piston body 10 that can now slide through the guide channel 15. The bow 43 acts in this manner as overload protection means. It prevents complete stop of the drive piston 8 due to its self-energizing principle.

Upon displacement of the drive piston 8 in its initial, ignition-ready position, the width of the respective sections of the eccentric washers 39, 40, which are located between the piston body 10 and the axles 41, 42, decreases, which insures the movement of the piston body 10 in its ignition-ready position relatively friction-free.

Figure 15:
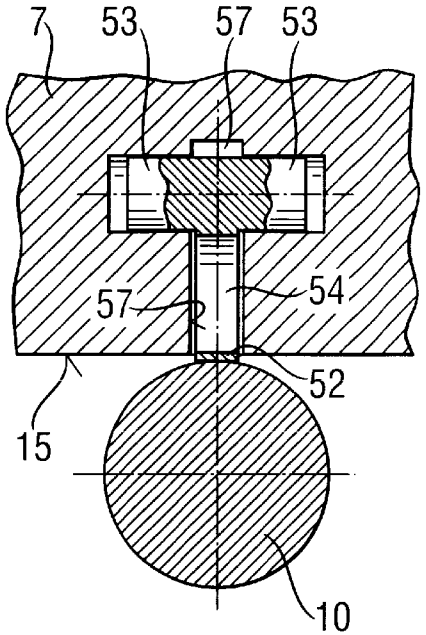
FIG. 15 a cross-sectional view along line XV—XV in FIG. 14.
Figure 14:
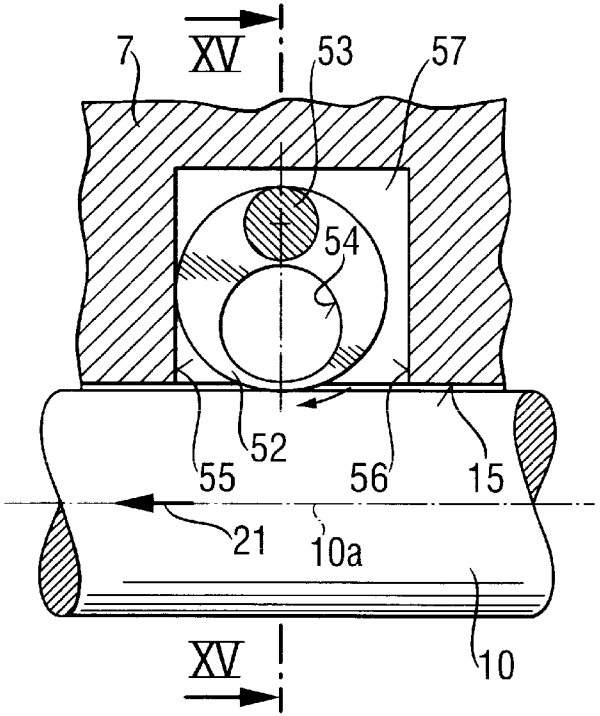
FIG. 14 a partial cross-sectional view showing the sixth embodiment of a piston holder according to the present invention with the elastic clamp member in its strong clamping position.
Figure 13:
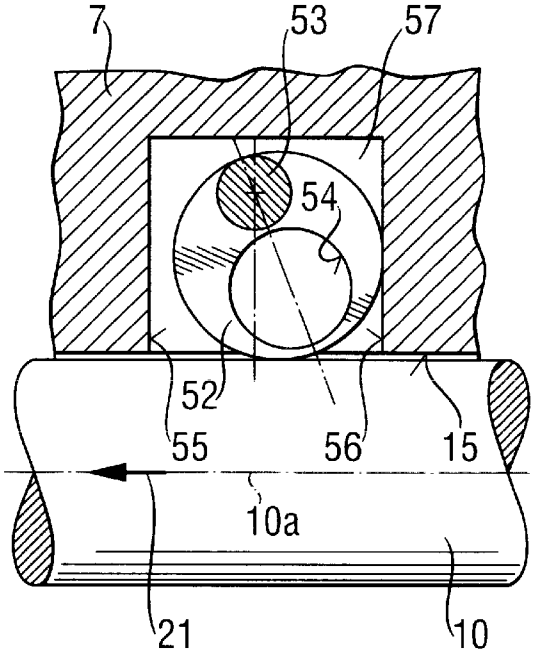
FIG. 13 a partial cross-sectional view showing the sixth embodiment of a piston holder according to the present invention with an elastic clamp member in its slightly clamping position.

A sixth embodiment of a piston holder according to the present invention is shown in FIGS. 13–15. In this embodiment likewise, a plurality of clamp members can be uniformly distributed over a circumference surrounding the piston body 10. The clamp members are designated with a reference numeral 52 and are formed as flat discs eccentrically supported on bearing or support axles 53.

Below, the structural and function of the piston holder of the sixth embodiment will be discussed with reference to a single clamp member. The support axle 53 extends tangentially relative to the piston body axis 10*a* and transverse to the plane of a respective clamp member 52, which coincides with the plane of the axis 10*a*. The clamp member 52 is formed as a circular disc that can be deflected in the radial direction. To this end, the disc or clamp member 52 is provided, e.g., with a circular opening 54. The outer diameter of the disc-shaped clamp member 52 isso selected that it is elastically pressed against the circumferential surface of the piston body 10 and pivots between two stops 55, 56 arranged at a distance from each other in the axial direction of the piston body 10. The stops 55, 56 form end walls of a pocket 57 in which the disc-shaped clamp member 52 is received. The stops 55, 56, which form the opposite walls of the pocket 57, extend radially relative to the piston body 10.

The piston holder according to the sixth embodiment functions as follows. In the ignition-ready position of the drive piston 8 and the piston body 10 shown in FIG. 13, the clamp member 52 engages the stop 56 with its circumference and presses against the piston body 10, retaining the drive piston 8 together with the piston body 10 in the ignition-ready position.

Upon ignition or firing of the setting tool, the drive piston 8, together with the piston body 10, moves in the setting direction 21 and, due to the friction between the piston body 10 and the clamp member 52, the latter would rotate about the eccentric axle 53 toward the front end of the setting tool. In course of this movement, pressing forces between the clamp member 52 and the piston body 10 increase. The pivotal movement of the clamp member 52 stops when its circumference engages the front stop 55. When the piston-displacing force increases above a predetermined value, the clamp member 52 is elastically deflected, releasing the piston body 10 that now slides through the guide channel 15. The clamp member 52, due to its elasticity, serves as overload protection means against a complete stop of the drive-piston 8.

Upon movement of the drive piston 8 to its initial, ignition-ready position, the piston body 10 pivots the clamp member 52 away from the front stop 55. The load on the clamp member 52 decreases, with a sharp reduction of friction between the clamp member 52 and the piston body 10. However, the friction is not reduced to zero because before the friction can reach the zero value, the clamp member 52 engages the rear stop 56, applying a slight pressure to the piston body 10.

Figure 17:
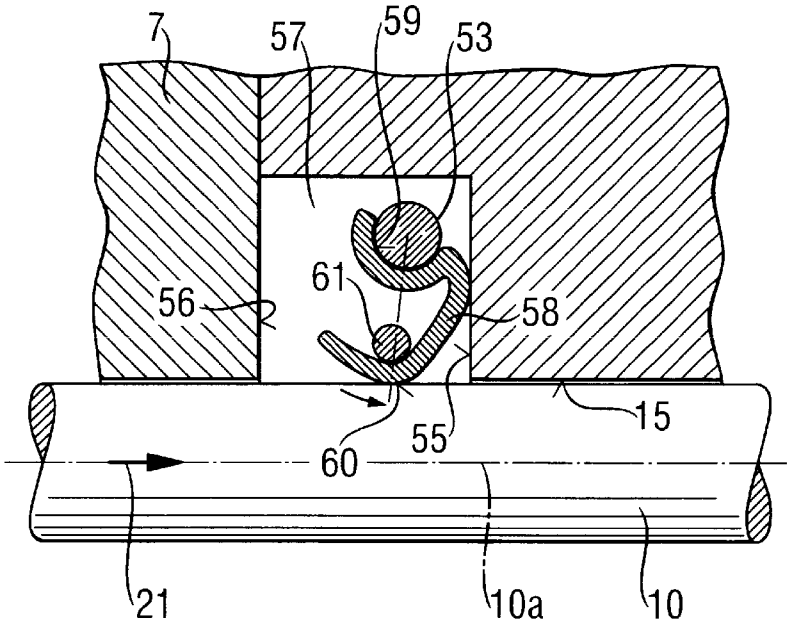
FIG. 17 a partial cross-sectional view showing the seventh embodiment of a piston holder according to the present invention with the elastic clamp member in its strong clamping position.
Figure 16:
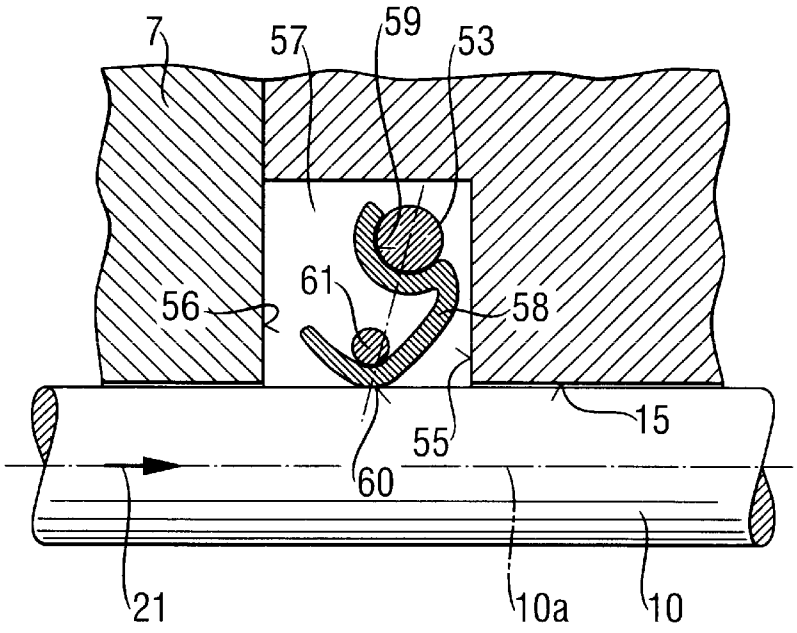
FIG. 16 a partial cross-sectional view showing a seventh embodiment of a piston holder according to the present invention with an elastic clamp member in its slightly clamping position.

The seventh embodiment of the piston holder according to the present invention is shown in FIGS. 16–17 in which the elements common with those of FIGS. 13–15, are designated with the same reference numerals.

The piston holder shown in FIGS. 16–17 likewise includes a plurality of clamp members 58 uniformly circumferentially distributed about the piston body 10. The structure and functioning of the clamp members again will be discussed with reference to a single clamp member 58. Each clamp member 58 is formed as an eccentric spring. The eccentric spring has, at one of its ends, a groove 59 for receiving a support axle 53, and is supported against the piston body 10 with its other, convex end 60. The end 60 is pressed against the piston body 10 by a ring spring 61 common for all of the clamp members 58. The clamp members 58 is so positioned in the pocket 57, that the contact point between the clamp members 58 and the piston body 10 is displaced, with respect to the bearing or support axle 53, rearwardly toward the rear end of the setting tool in the ignition-ready position of the drive position 8 shown in FIG. 16. The eccentric spring, which forms the clamp member 58, is open toward the rear end of the setting tool.

In the ignition-ready position of the drive piston 8 and the piston body 10, the ring spring 61 biases the clamp members 58 against the circumference of the piston body 10, reliably retaining the piston body 10, i.e., the drive piston 8 in the ignition-ready position. This is the case when the setting tool is pressed particularly hard against a constructional component.

Upon ignition or firing of the setting tool, the drive piston 8 moves in the setting direction 21, which results in that the clamp members 58 is pressed against the piston body 10 more strongly as a result of entraining of the clamp members 58 by the piston body 10. As a result, the frictional forces between the clamp members 58 and the piston body 10 increase until the clamp members 58 engages the front, in the setting direction, stop 55. When the piston-displacing force increases above a predetermined value, the clamp member-forming eccentric springs become elastically deformed, releasing the drive piston 8 that slides now through the guide channel 15. The clamp member-forming eccentric springs serve as overload protection means against the complete stop of the drive piston 8. Upon movement of the drive piston 8 back to its initial position, the clamp members 58 are entrained by the piston body 10 and become substantially released, providing for a substantially friction-free movement of the drive piston 8.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A piston holder for a drive piston (8) of a setting tool, comprising at least one clamp member (18; 24; 25; 36; 39; 40; 52; 58) that is constantly non-rigidly pressed against a circumference of the drive piston (8); and means for supporting the at least one clamp member for an eccentric movement in a plane in which a central axis (10*a*) of the drive piston (8) is located.

2. A piston holder according to claim 1, wherein the at least one clamp member (18; 24; 25; 36) is so formed that it is tiltably supported in a receiving cavity that is stationary with respect to the setting tool.

3. A piston holder according to claim 2, wherein the supporting means comprises a stop (22, 32) provided in the receiving cavity and located in front of the at least one clamp member in a drive-out direction of the drive piston (8).

4. A piston holder according to claim 2, wherein the at least one clamp member is formed as a rigid body, and the supporting means comprises means (17; 19; 28) for biasing the at least one clamp member against the drive piston (8).

5. A piston holder according to claim 2, wherein the at least one clamp member (24, 36) is formed as an elastic body supportable against a cavity wall extending radially relative to the drive piston for impinging the drive piston (8).

6. A piston holder according to claim 1, wherein the supporting means comprises an eccentric axle (41; 42; 53) for pivotally supporting the at least one clamp member (39; 40; 52; 58).

7. A piston holder according to claim 6, wherein the at least one clamp member (52; 58) is formed as an elastic body, and the eccentric axle (53) is fixedly securable in the setting tool.

8. A piston holder according to claim 7, wherein the supporting means further comprises a stop (55) arranged in front of the at least one clamp member (52; 58) in a drive-out direction (21) of the drive piston (8).

9. A piston holder according to claim 6, wherein the eccentric axle (41; 42) is non-rigidly supported in a radial direction of the drive piston (8).

10. A piston holder according to claim 9, wherein the at least one clamp member (39; 40) is formed as a rigid body.

11. A pivot holder according to claim 10, further comprising an elastic stop (46, 47) for limiting a pivotal movement of the at least one clamp member during movement of the drive piston (8) in a direction opposite drive-out direction thereof.

12. A piston holder according to claim 1, wherein the at least one clamp member (39; 40) has a convex bearing surface for pressing against the drive piston (8).

13. A piston holder according to claim 1, comprising a plurality of clamp member uniformly distributed in a circumferential direction of the drive piston (8).

14. A piston holder according to claim 9, wherein the eccentric axle is formed by an end of a bow (43).

15. A piston holder according to claim 13 further comprising a common ring spring (28; 34; 61) for biasing all of the plurality of clamp members against the piston body (10).

* * * * *